US006080015A

United States Patent [19]

Andreescu

[11] Patent Number: 6,080,015

[45] Date of Patent: Jun. 27, 2000

[54] METHOD FOR CONNECTING COAXIAL CABLES AND CONNECTOR FOR THAT PURPOSE

[75] Inventor: Paul Andreescu, Brussels, Belgium

[73] Assignee: SEE SPRL, Braine l'Alleud, Belgium

[21] Appl. No.: 09/196,465

[22] Filed: Nov. 19, 1998

Related U.S. Application Data

[63] Continuation of application No. PCT/EP97/02603, May 21, 1997.

[51] Int. Cl.[7] ..... H01R 9/05

[52] U.S. Cl. ..... 439/584; 439/394

[58] Field of Search ..... 439/584, 583, 439/461, 462, 394

[56] References Cited

U.S. PATENT DOCUMENTS

| | | | |
|---|---|---|---|
| 3,526,871 | 9/1970 | Hobart | 439/584 |
| 4,352,950 | 10/1982 | Meier . | |
| 5,318,458 | 6/1994 | Thorner . | |
| 5,518,420 | 5/1996 | Pitschi . | |

FOREIGN PATENT DOCUMENTS

| | | |
|---|---|---|
| 2680606 | 2/1993 | France . |
| 2277207 | 10/1994 | United Kingdom . |

*Primary Examiner*—Steven L. Stephan
*Assistant Examiner*—Javaid Nasri
*Attorney, Agent, or Firm*—Maria Parrish Tungol; John A. Parrish

[57] ABSTRACT

A connector for coaxial cables having an inner conductor (14) and an outer conductor (10) separated by a dielectric (16) includes a front body (4) to attach a coaxial cable in the connector and a rear body (8) adapted for connection to the front body (4), and a device for holding the cable in the connector in a manner that permits reproducible deformation of the outer conductor (10) during the connecting operation. The device for holding the cable in position is comprised of a ferrule (1) for holding the coaxial cable, and a bushing (2) that cooperates with the ferrule (1) to permit axial movement of the coaxial cable over a determined distance (L) in the connector during the connecting operation. The surfaces of ferrule (1) and bushing (2) cooperate to produce reproducible compression and/or deformation of the outer conductor (10) between said ferrule (1) and said bushing (2) during said connecting operation. The connector enables the coaxial cable to be deformed during the connection operation in an automatically reproducible manner without requiring precise measurements or special tools. The impedence fault value produced by the deformation of the outer conductor can be predetermined and is automatically reproduced during each connection operation.

16 Claims, 4 Drawing Sheets

METHOD FOR CONNECTING COAXIAL CABLES AND CONNECTOR FOR THAT PURPOSE

This is a continuation of International Application PCT/EP97/02603, with an international filing date of May 21, 1997.

FIELD OF THE INVENTION

The present invention relates to connectors for coaxial cables, in particular for high frequency ones utilized in telecommunications or cable television.

BACKGROUND OF THE INVENTION

One of the conditions necessary for ensuring high frequency signal transmission with minimum loss in the coaxial transmission lines, respectively coaxial cables and connectors, is to maintain a constant impedance over the entire length of the transmission line.

The impedance is directly linked to the transverse dimensions of the central conductor, the outer conductor and to the $\epsilon$ of the central dielectric. If the cables have a constant section over their entire length, this section is sometimes modified at the attachment location of the connector, especially if the outer conductor has to be deformed in order to ensure electric contact and the attachment of the cable. Modifying the dimensions of the cable causes an impedance fault which must be compensated in the connector. This compensation can be regulated. It is therefore only valid for a very precise impedance fault value, which is difficult to carry out during the assembly of the connector on the cable.

The connector for coaxial cables according to the present invention enables the cable to be attached by deforming the outer conductor (which ensures electric contact and the attachment of the connector) in an automatically reproducible manner without requiring precise measurements or subjective estimations during assembly, nor special tools.

The general principle of such a connector is known from the German patent 42 07 482 which specifies a method for connecting coaxial cables provided with an annularly corrugated outer conductor (ringförming gewellter Mantelrohr). The cable is cut at a corrugation trough and a piece destined to hold the cable is placed in the trough of the following corrugation. During the connecting operation of a front body and a rear body of the connector the corrugation left free by the holding piece is crushed in a relatively reproducible manner between the front body and the holding piece. This type of known connector nevertheless has the inconvenience that it does not prevent the rotation of the cable in the holding piece during the connecting operation, which can detract from the good reproducibility of the deformation of the outer conductor. Furthermore this type of connector is entirely specific to coaxial cables provided with an annularly corrugated outer conductor. It is therefore not suited to smooth outer conductor or spiralled outer conductor coaxial cables.

The present invention also includes method for connecting coaxial cables which remedies these inconveniences and due to which the deformation of the outer conductor of the cable is always identically the same.

SUMMARY OF THE INVENTION

The method according to the invention, intended for connecting coaxial cables provided with an inner conductor and an outer conductor separated by a dielectric, by connecting a front body destined to attach the cable and a rear body, whereas a device holds the cable in position in such a manner as to cause a reproducible deformation of the outer conductor, involves the utilization of a ferrule destined to hold the cable, and of a bushing which work together in order to enable an axial movement over a determined distance of the ferrule and of the cable in relation to the bushing.

Preferably the deformation of the outer conductor is caused and determined by a front plane of the aforesaid bushing.

This method embodies a new connector which itself is also the object of the invention.

This connector according to the invention, for coaxial cables provided with an inner conductor and an outer conductor separated by a dielectric, comprising a front body destined to attach the cable in the connector and a rear body destined to be connected to the front body, as well as a device destined to hold the cable in position in relation to the connector in such manner as to enable a reproducible deformation of the outer conductor during the connecting operation, this device destined for holding the cable in position consisting of at least two parts working together in order to hold and guide the cable in a reproducible manner, comprising a ferrule destined to hold the cable, and a bushing working together with the ferrule in such manner as to enable an axial movement over a determined distance of the ferrule and of the cable in relation to the bushing during the connecting operation.

According to a preferred characteristic of the invention the bushing comprises a front plane whose shape determines the deformation of the outer conductor.

The connector according to the invention can also advantageously comprise a sealing collar provided between the rear body and the parts working together in order to hold and guide the cable.

According to a first particular embodiment of the invention the connector can more specifically be provided in order to be utilized with spiralled outer conductor coaxial cables. In this case the ferrule can advantageously be provided with a special thread enabling the spiralled conductor to be screwed thereon whereas the ferrule and the bushing have a geometry prohibiting a rotation of the ferrule and of the bushing one in relation to the other and in relation to the cable.

In this embodiment the ferrule and the bushing are preferably each provided with zones with mutually fitting flat parts, prohibiting a rotation of the ferrule and of the bushing one in relation to the other, and with grooves destined to lodge a collar there enabling the movement of the ferrule in relation to the bushing with a determined stroke.

According to another particular embodiment of the invention the connector can more specifically be provided in order to be utilized with smooth outer conductor coaxial cables. In this case the ferrule can advantageously be provided with a longitudinal slot enabling the diameter of the ferrule to be tightened, and with an inner thread or profile enabling the smooth outer conductor to be gripped during the tightening of the ferrule. In this embodiment the ferrule is preferably provided, on the side of the bushing, with a cone on the outside and on the inside, and the bushing with a cone at the entrance and in the base, the outside cone of the ferrule being destined to work together with the cone at the entrance of the bushing in order to cause the tightening of the slotted ferrule, and the cone at the base of the bushing being destined to cause the well-defined deformation of the outer conductor, by working together with the inside cone of the ferrule. In this embodiment the parts working together in order to hold and guide the cable in a reproducible manner, can moreover usefully comprise a collar destined to move the ferrule forward during the assembly of the rear body of the conductor, enabling the ferrule to be wedged between the bushing and the collar.

BRIEF DESCRIPTION OF THE DRAWINGS

Other details and characteristic will ensue from the specification of a connector for coaxial cables according to the invention, illustrated by the drawings attached hereto.

In these drawings.

DETAILED DESCRIPTION OF THE INVENTION

Figure 1:
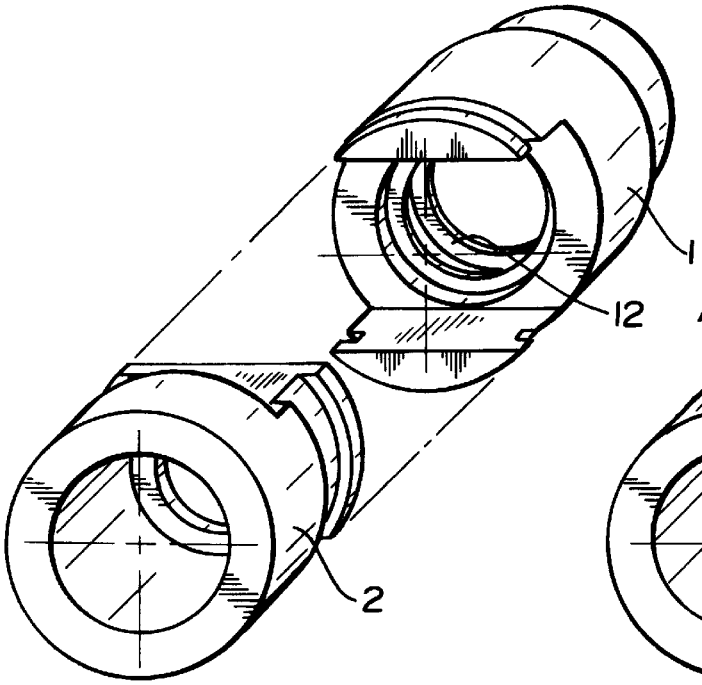
FIG. 1 represents a view in perspective of the holding parts (ferrule and bushing, shown separately) of a connector according to a first embodiment of the invention (connector for spiralled outer conductor cables)
Figure 2:
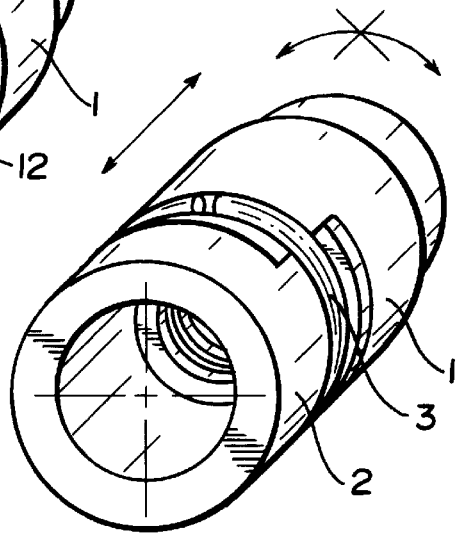
FIG. 2 represents a view in perspective of the parts from FIG. 1, shown assembled.

FIGS. 1 and 2 represent the ferrule (1) which holds the cable and the bushing or guiding piece (2) of the first embodiment of the invention, as well as the assembly of these two parts with collar (3). For this example, the cable is a coaxial cable with spiralled outer conductor (10). The ferrule (1) is provided on the inside with a special thread (12) which enables the outer conductor of the cable to be screwed into it and has a geometry which enables its rotation around its axis to be prevented while maintaining the possibility of axial displacement which can in this case be an zone with two flat parts which fit the two flat parts of the bushing (2). Moreover, the ferrule is provided on the outside with a groove in which the collar (3) is lodged. The bushing (2) is in its turn provided with a groove on the outside, in order to lodge the collar (3) when it is fitted into the ferrule (1). The bushing (2) has a groove wider than the thickness of the collar (3) which holds it to the ferrule (1), which enables a movement of the ferrule (1) with a limited stroke that is always the same.

Figure 3:
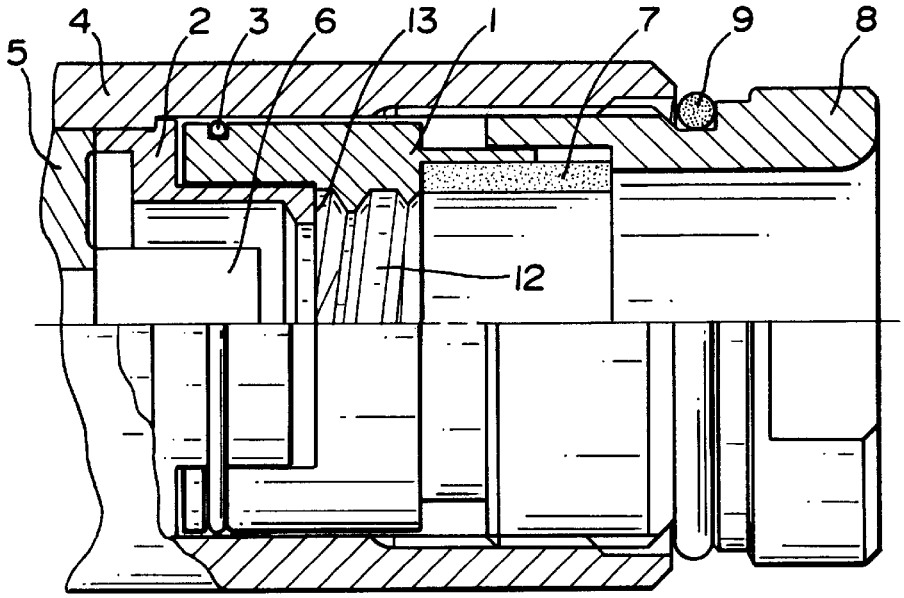
FIG. 3 represents an elevation view, in partial cross-section, of a connector according to the invention utilizing the holding parts from FIGS. 1 and 2.

FIG. 3 represents a coaxial connector that is the subject of the invention. The body (4) contains the dielectric (5) which holds the central contact (6). Always attached inside the body (4) and forming one piece with this is the bushing (2) that forms the guiding part, which is assembled with the ferrule (1) by means of the collar (3).

On the side of the rear part (8) of the connector, the ferrule (4) is provided with a tubular zone which can engage into the back (8) and which lodges the joint (7) which ensures impermeability over the outer conductor and the jacket of the cable. Impermeability between the body (4) and the back (8) is ensured by the joint (9).

Figure 4:
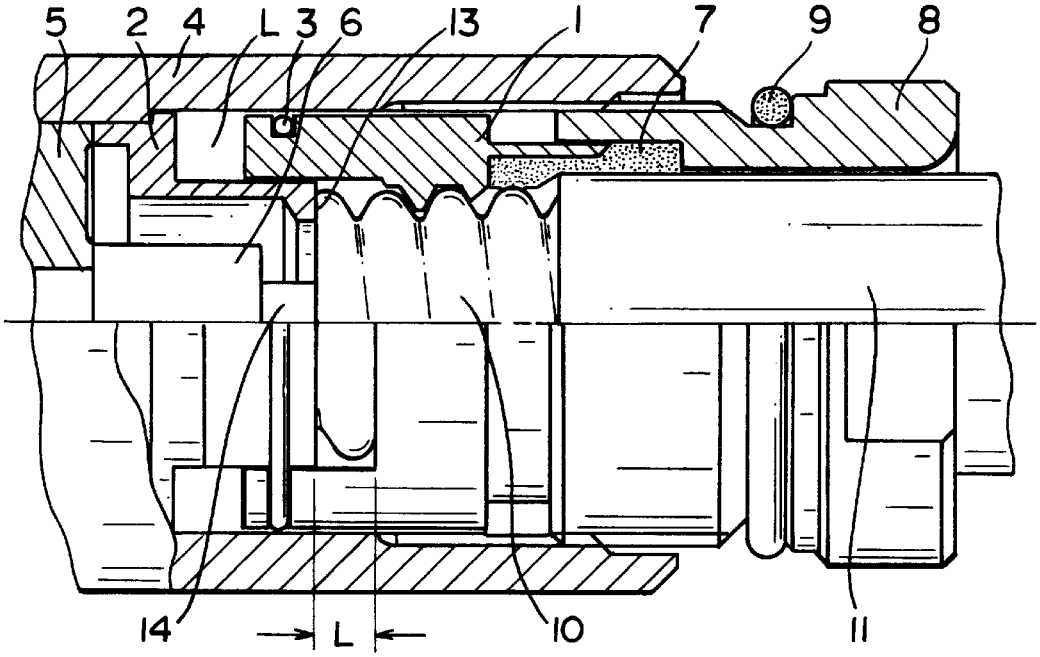
FIG. 4 represents a view corresponding to FIG. 3, showing the connector with a coaxial cable, prior to the outer conductor deformation operation.
Figure 5:
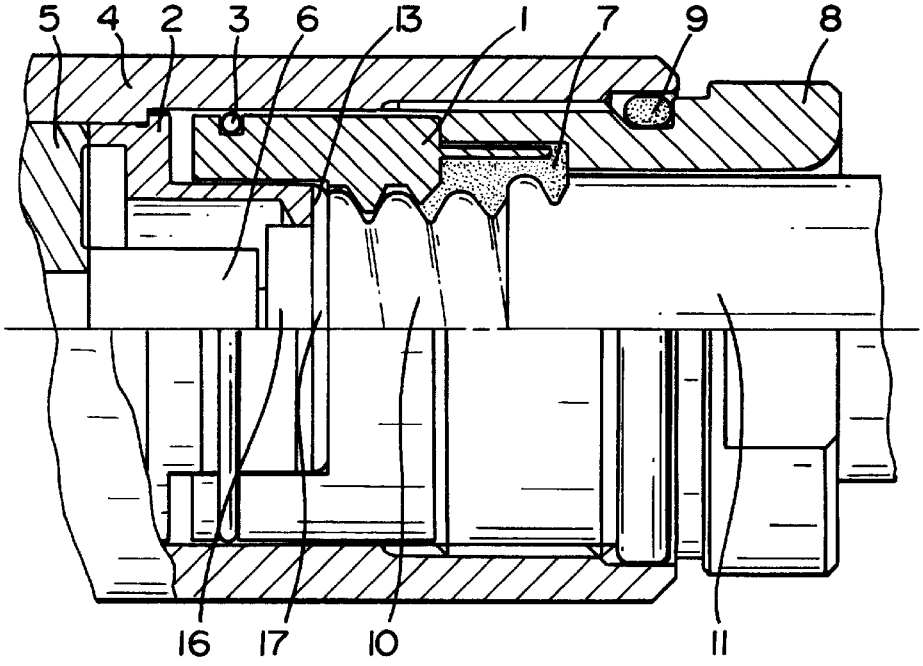
FIG. 5 represents a view corresponding to FIG. 4, after to the outer conductor deformation operation.

FIGS. 4 and 5 illustrate the operation of the connector. In FIG. 4, it will be noted that by screwing the connector onto the cable, the central contact (6) of the connector receives the central conductor (14) of the cable. The ferrule (1) accepts the outer conductor (10) of the cable by moving apart from the guiding part (2) to a maximum distance (L) limited by the collar (3). The joint (7) is around the outer conductor (10) and the jacket of the cable (11).

In FIG. 5, it can be seen that by screwing the back (8) this causes the ferrule (1) to move forward and compress the joint (7) which molds around the outer conductor and the jacket of the cable. In a second stage, the back (8) is able to touch and push the ferrule (1) which moves forward toward the bushing (2) by deforming the outer conductor (10) of the cable in order to ensure a good contact. According to the shape of the front plane (13) of the bushing (2) on the side of the ferrule (1) and to the shape of this, the outer conductor of the cable can be compressed or flared. In the embodiment represented, the outer conductor (10) is deformed against the front plane (13) of the bushing (2), whereas the dielectric (16) which is between the outer conductor (10) and the central conductor (14) penetrates into the bushing (2); the conductor (10) undergoes a final deformation (17) illustrated in FIG. 5. As the deformation of the outer conductor of the cable, determined by the length (L), is rigorously reproducible, a reproducible impedance fault is created which can be electrically compensated by proper dimensioning of the connector.

Figure 6:
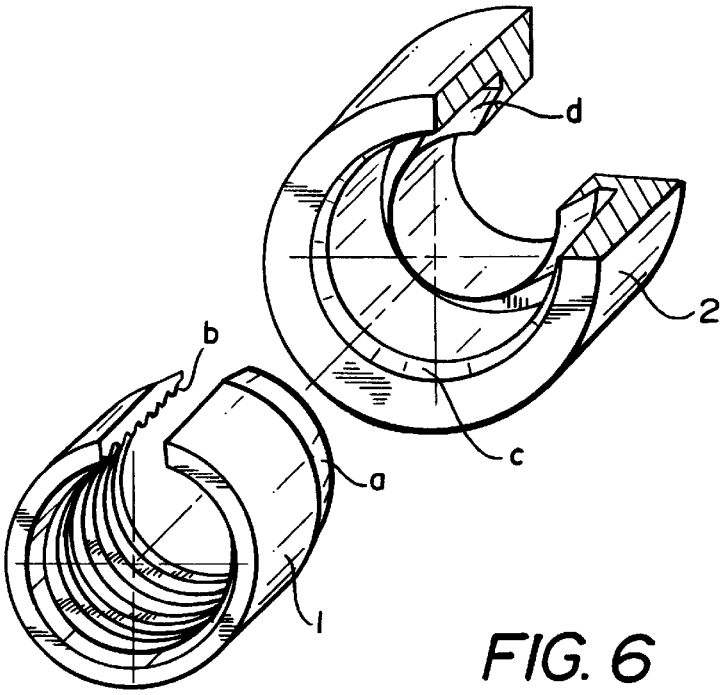
FIG. 6 represents a view in perspective of the holding parts (ferrule and bushing, shown separately) of a connector according to a second embodiment of the invention (connector for smooth outer conductor cables)

FIG. 6 represents the ferrule (1) and the bushing (2) of the second embodiment of the invention. The ferrule (1) has a longitudinal slot and is provided on the inside with a thread or profile which enables the outer conductor of the cable to be gripped. Moreover, the ferrule (1) is provided on the side of the bushing (2) with a cone (a) on the outside and with a cone (b) on the inside.

The bushing (2) is provided with a cone (c) at the entrance and with a cone (d) in the base.

Figure 7:
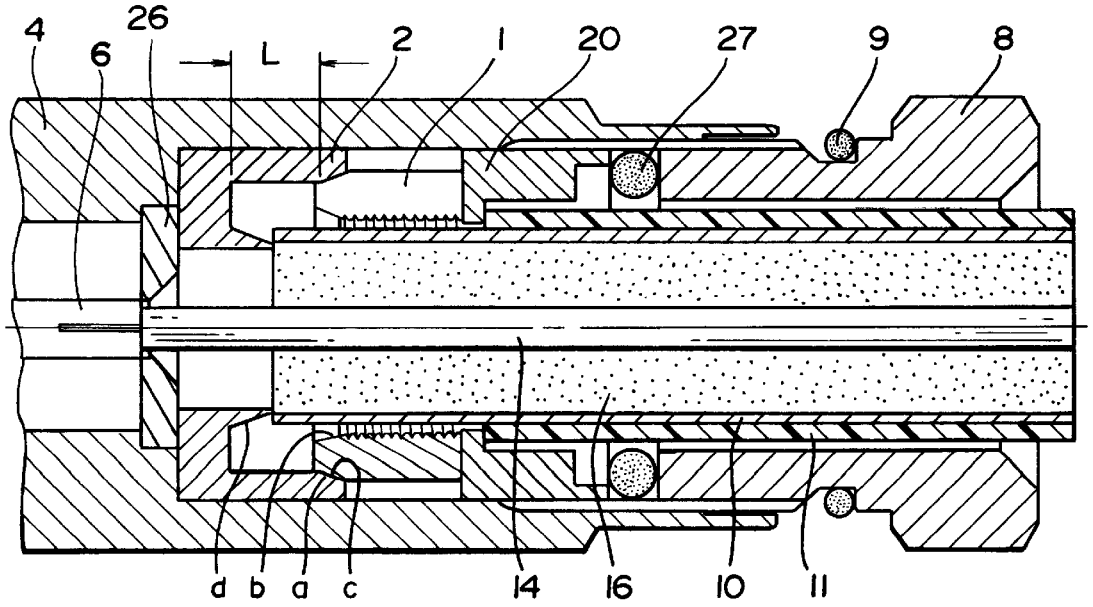
FIGS. 7 through 9 represent cross-sections of a connector according to the invention utilizing the holding parts from FIG. 6, disposed on a coaxial cable, shown in successive phases of the outer conductor securing and deformation operation.

FIG. 7 represents a coaxial connector for smooth outer conductor coaxial cables, subject of the invention. On the inside of the body (4) is the central contact (6) and behind that the guide (26) for the central conductor (14) of the cable. Always attached inside the body (4) and forming one piece with it is the bushing or guiding part (2). The ferrule is wedged between the bushing (2) and the collar (20).

Behind the collar (20), there is the toroidal sealing ring (27) and the back (8) which is provided with the toroidal sealing ring (9) in the groove of the thread.

The cable is fitted into the connector. The central conductor (14) of the completely bared cable is inserted into the central contact (6). The dielectric (16) and the outer conductor (10) of the cable are cut in the same plane and will press against the cone (d) which is in the base of the bushing (2). The outer conductor (10) of the cable is bared of the jacket (11) to behind the smallest bore of the collar (20).

Figure 8:
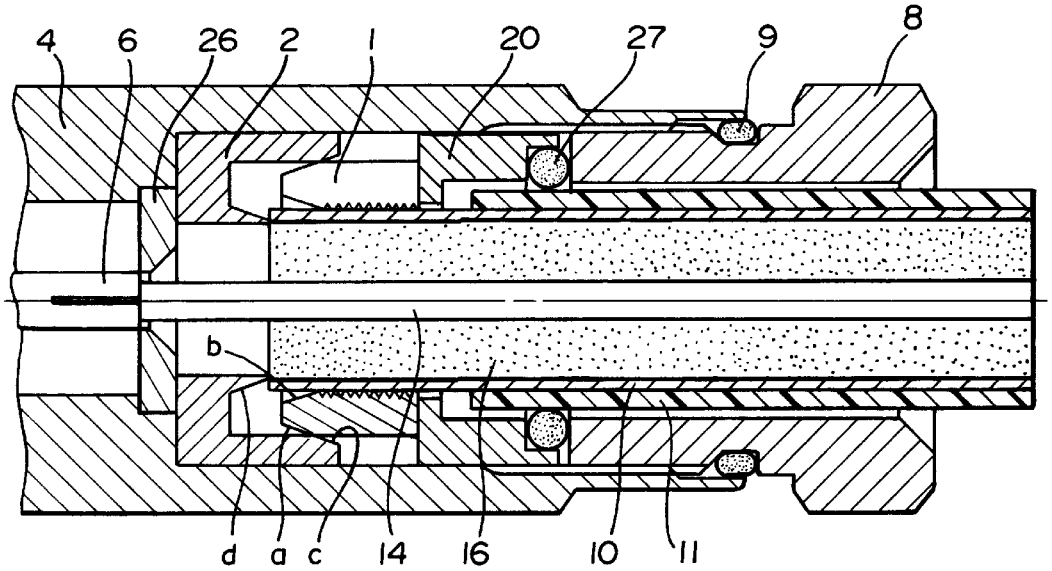
Figure 9:
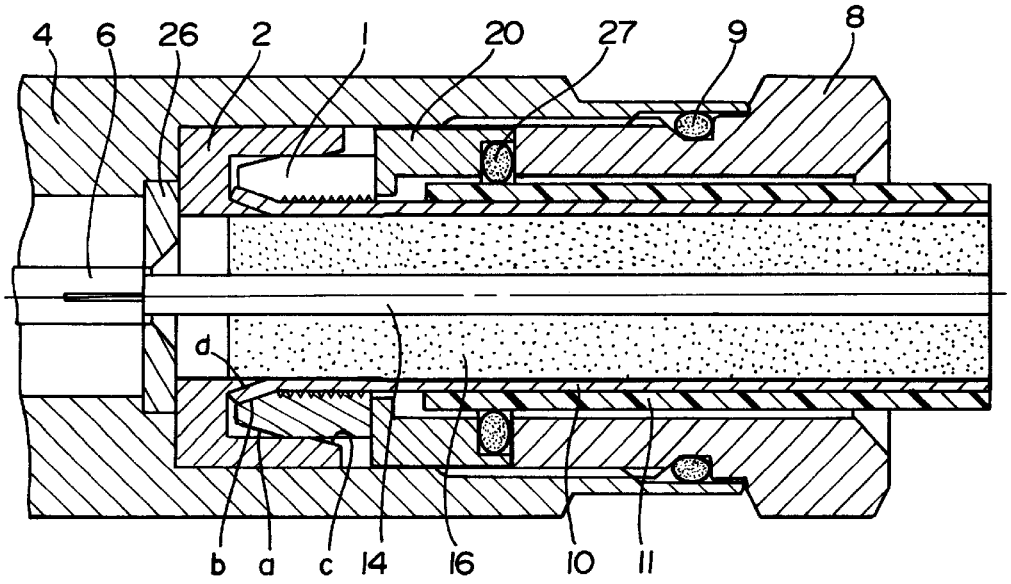

FIGS. 8 and 9 illustrate the operation of the connector. In FIG. 8, it will be noted that by screwing the back (8) the joint (27) enters into the bore of the collar (20). The collar (20), pushed by the back (8) causes the ferrule (1) to move forward which presses into the entrance cone (c) of the bushing (2) and grips onto the outer conductor (10) of the cable.

In FIG. 8, it will be seen that by continuing to screw the back (8), the ferrule (1) moves forward with the cable into the bushing (2). The outer conductor (10) of the cable is flared by the cone (d) which is in the base of the bushing (2) and is pressed between this cone (d) and the inner cone (b) of the ferrule (1) ensuring electric contact and the attachment of the cable. The dielectric (16) of the cable moves forward underneath the cone (d) which is in the base of the bushing (2). The toroidal sealing ring (27) is compressed in order to ensure impermeability between the back (8) and the jacket (11) of the cable. The toroidal sealing ring (9) ensures impermeability between the body (4) and the back (8). As the deformation of the outer conductor (10) of the cable, determined by the length (L), is rigorously reproducible, a reproducible impedance fault is created which can be electrically compensated by proper dimensioning of the connector. Moreover, the coring of the dielectric is eliminated which is necessary for certain cables in order to maintain characteristic impedance resulting from the insertion of a tubular mandrel under the outer conductor of the cable in order to tighten it.

It should be noted that the specific details described above relating to the two particular embodiments of the invention illustrated in the drawings are only given as preferred examples of the general object of the invention and may in no way be interpreted as restricting the scope of this invention as stated above and in the claims which follow.

I claim:

1. A connector for coaxial cables having an inner conductor (14) and an outer conductor (10) separated by a dielectric (16), comprising a front body (4) for attaching a coaxial cable in the connector, a rear body (8) adapted for connection to the front body (4), and a device for holding the coaxial cable in the connector comprising a ferrule (1) and a bushing (2) having a front plane (13) wherein the bushing (2) is adapted to cooperate with the ferrule (1) to compress or deform the outer conductor (10) by contact of the front plane (13) with an edge of the outer conductor (10).

2. A connector according to claim 1 wherein a gasket (7) is provided between the rear body (8) and the outer conductor (10).

3. The connector according to claim 1, provided for being utilized with smooth outer conductor coaxial cables, wherein the ferrule (1) is provided with a longitudinal slot enabling the diameter of the ferrule to be tightened, and with an inner thread or profile enabling the smooth outer conductor to be gripped during the tightening of the ferrule.

4. The connector according to claim 3 further comprising a collar (20) destined to move the ferrule forward during the assembly of the rear body (8) of the conductor, enabling the ferrule to be wedged between the bushing and the collar.

5. A connector according to claim 1 wherein the ferrule (1) and the bushing (2) cooperate to enable axial movement of the ferrule (1) and the coaxial cable over a predetermined distance (L) relative to the bushing (2) during a connecting operation.

6. A connector according to claim 1 wherein the front plane (13) is configured to enable the outer conductor (10) to be compressed by contact with the front plane (13).

7. A connector according to claim 1 wherein the front plane (13) is configured to enable the outer conductor (10) to be flared by contact with the front plane (13).

8. A method for connecting coaxial cables having said inner conductor (14) and said outer conductor (10) separated by said dielectric (16) wherein the outer conductor (10) is deformed over a predetermined distance L by connecting a coaxial cable within a connector according to claim 13.

9. The method according to claim 8 wherein the outer conductor is deformed by contact with the front plane (13) of the bushing (2).

10. The connector for coaxial cables having an inner conductor (14) and an outer conductor (10) separated by a dielectric (16), comprising a front body (4) for attaching a coaxial cable in the connector, a rear body (8) adapted for connecting to the front body (4), and a device for holding the cable comprising a ferrule (1) and a bushing (2) containing a base cone (d) wherein the bushing (2) cooperates with the ferrule (1) to compress or deform the outer conductor (10) by contact of the base cone (d) with the outer conductor (10).

11. The connector for coaxial cables according to claim 10 wherein the ferrule (1) includes (i) a longitudinal slot and an inner thread or profile to enable the outer conductor (10) to be gripped during the tightening of the ferrule (1), (ii) an outside cone (a) on the outside of ferrule (1), and (iii) an inside cone (b) on the inside of said ferrule (1), and the bushing (2) includes an entrance cone (c) at the entrance of said bushing (2) and said base cone (d) in the base of said bushing (2) wherein the outside cone(a) cooperates with the entrance cone (c) to tighten the ferrule (1) around the cable and wherein said base cone (d) cooperates with the inside cone (b) to deform the outer conductor (10).

12. A method for connecting coaxial cables having said inner conductor (14) and with said outer conductor (10) separated by said dielectric (16) wherein the outer conductor (10) is deformed over a predetermined distance L by connecting a coaxial cable within a connector according to claim 17.

13. The method according to claim 12 wherein the outer conductor is deformed by contact with said base cone (d) in the base of the bushing (2).

14. A connector for spiralled outer conductor coaxial cables, said coaxial cables having an inner conductor (14) and an outer conductor (10) separated by a dielectric (16), comprising a front body (4) destined to attach the cable in the connector and a rear body (8) destined to be connected to the front body (4), and a device comprising a ferrule (1) destined to hold the cable, and a bushing (2) working together with the ferrule (1) in such manner as to enable an axial movement over a determined distance (L) of the ferrule and of the cable in relation to the bushing during the connecting operation, and wherein said ferrule (1) and said bushing (2) comprise cooperating surfaces which enable compression and/or deformation of the outer conductor between said ferrule (1) and said bushing (2) during said connecting operation, said ferrule (1) being provided with a thread enabling the spiralled conductor to be screwed thereon and wherein said ferrule and said bushing cooperate to prevent rotation of the ferrule and of the bushing one in relation to the other and in relation to the cable.

15. The connector according to claim 14, wherein the ferrule (1) and the bushing (2) are each provided with grooves destined to lodge a collar (3) thereby enabling the movement of the ferrule in relation to the bushing.

16. A connector for smooth outer conductor coaxial cables, said coaxial cables having an inner conductor (14) and an outer conductor (10) separated by a dielectric (16), comprising a front body (4) destined to attach the cable in the connector and a rear body (8) destined to be connected to the front body (4), and a device comprising a ferrule (1) destined to hold the cable, and a bushing (2) working together with the ferrule (1) in such manner as to enable an axial movement over a determined distance (L) of the ferrule and of the cable in relation to the bushing during the connecting operation, and wherein said ferrule (1) and said bushing (2) comprise cooperating surfaces which enable compression and/or deformation of the outer conductor between said ferrule (1) and said bushing (2) during said connecting operation, said ferrule (1) being provided with a longitudinal slot enabling the diameter of the ferrule to be tightened, and with an inner thread or profile enabling the smooth outer conductor to be gripped during the tightening of the ferrule, and said ferrule (1) being provided on the side contacting said bushing (2) with an outside cone (a) on the outside of said ferrule (1) and with an inside cone (b) on the inside of said ferrule (1), and said bushing (2) being provided with an entrance cone (c) at the entrance of said bushing (2) and with a base cone (d) inside said bushing (2), the outside cone (a) of the ferrule being destined to work together with the entrance cone (c) of the bushing in order to cause the tightening of the slotted ferrule, and the base cone (d) inside the bushing being destined to cause the deformation of the outer conductor, by working together with the inside cone (b) of the ferrule.

* * * * *